US010642211B2

(12) United States Patent
Deno

(10) Patent No.: US 10,642,211 B2
(45) Date of Patent: May 5, 2020

(54) IMAGE FORMING APPARATUS

(71) Applicant: CANON KABUSHIKI KAISHA, Tokyo (JP)

(72) Inventor: Kohei Deno, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/109,954

(22) Filed: Aug. 23, 2018

(65) Prior Publication Data

US 2019/0072893 A1 Mar. 7, 2019

(30) Foreign Application Priority Data

Sep. 6, 2017 (JP) ..... 2017-171596

(51) Int. Cl.
*B65H 29/60* (2006.01)
*B65H 85/00* (2006.01)
(Continued)

(52) U.S. Cl.
CPC ..... *G03G 15/6561* (2013.01); *B65H 5/062* (2013.01); *B65H 5/26* (2013.01); *B65H 9/006* (2013.01); *B65H 29/60* (2013.01); *B65H 85/00* (2013.01); *G03G 15/23* (2013.01); *G03G 15/234* (2013.01); *G03G 15/6579* (2013.01); *B65H 2301/33312* (2013.01);
(Continued)

(58) Field of Classification Search
CPC ..... B65H 29/60; B65H 2301/33312; B65H 85/00; G03G 15/234; G03G 15/6579; G03G 2215/00438; G03G 2215/0043
See application file for complete search history.

(56) References Cited

U.S. PATENT DOCUMENTS 6,577,844 B2 * 6/2003 Kamei ..... G03G 15/234 399/301
7,607,658 B2 * 10/2009 Fujiwara ..... B65H 15/00 271/186
(Continued)

FOREIGN PATENT DOCUMENTS

JP 10167542 A * 6/1998
JP 2002-365862 A 12/2002
(Continued)

*Primary Examiner* — Luis A Gonzalez
(74) *Attorney, Agent, or Firm* — Venable LLP

(57) ABSTRACT

A first conveyance member reverses a sheet received from a first conveyance path. Second through fourth conveyance members are disposed on a second conveyance path and convey a sheet from the first conveyance member toward the first conveyance path. A restriction portion is capable of restricting driving force of a first driving source from acting on a sheet through the second conveyance member. A controller executes a first operation and a second operation. In the first operation, a second driving source stops driving the third and fourth conveyance members while a first sheet is being nipped at the fourth conveyance member, and a second sheet is conveyed to be abutted with the third conveyance member. In the second operation, the second driving source starts driving the third and fourth conveyance members while the restriction portion restricts driving force of the first driving source from acting on the second sheet.

11 Claims, 13 Drawing Sheets

(51) Int. Cl.

| | |
|---|---|
| ***G03G 15/00*** | (2006.01) |
| ***B65H 9/00*** | (2006.01) |
| ***B65H 5/06*** | (2006.01) |
| ***B65H 5/26*** | (2006.01) |
| ***G03G 15/23*** | (2006.01) |

(52) U.S. Cl.
CPC .... *B65H 2403/72* (2013.01); *B65H 2404/143* (2013.01); *B65H 2404/144* (2013.01)

(56) References Cited

U.S. PATENT DOCUMENTS

| | | | | |
|---|---|---|---|---|
| 8,849,146 | B2 * | 9/2014 | Campbell | G03G 15/234 399/402 |
| 9,581,928 | B2 | 2/2017 | Deno | |
| 2017/0235254 | A1 | 8/2017 | Deno | |
| 2017/0235265 | A1 | 8/2017 | Deno | |
| 2017/0235269 | A1 | 8/2017 | Deno | |
| 2018/0157200 | A1 * | 6/2018 | Endoh | G03G 15/6564 |

FOREIGN PATENT DOCUMENTS

| | | | | |
|---|---|---|---|---|
| JP | 2004-269090 | A | | 9/2004 |
| JP | 2006062851 | A | * | 3/2006 |
| JP | 5720438 | B2 | | 5/2015 |
| JP | 5984488 | B2 | | 9/2016 |

* cited by examiner

IMAGE FORMING APPARATUS

BACKGROUND OF THE INVENTION

Field of the Invention

The present invention relates to an image forming apparatus configured to form an image on a sheet.

Description of the Related Art

An image forming apparatus such as a printer, a copier and a multi-function printer widely adopts a configuration for forming images on both sides of a sheet. Typically, after an image is formed on one side of a sheet by an image forming portion, the sheet is switched back by a reverse conveyance roller pair that rotates normally and reversely and conveyed to the image forming portion again, and another image is formed on the other side of the sheet.

Japanese Patent No. 5720438 discloses a configuration capable of conveying three sheets simultaneously in a sheet re-feeding path from the reverse conveyance roller pair to a registration roller pair via a plurality of re-feeding roller pairs. In this configuration, the reverse conveyance roller pair, an upstream re-feeding roller pair and a downstream re-feeding roller pair are driven respectively by different motors, and driving speeds of these motors are independently controlled.

By the way, it is necessary to temporarily stop image forming on a sheet when, for example, large-volume image data is being read. Even in such a case, if the apparatus is provided with three motors for controlling conveyance of three sheets as the above-identified document, it is possible to make the sheets wait at appropriate positions while avoiding collision of the sheets by independently controlling each motor. This configuration, however, leads to increase in production cost of the apparatus because more motors are required as the number of sheets to be kept waiting in the sheet re-feeding path increases.

SUMMARY OF THE INVENTION

The present invention provides an image forming apparatus in which a plurality of sheets are made to wait at appropriate positions in duplex printing and which can realize reduction in production cost.

According to one aspect of the present invention, an image forming apparatus includes: a first conveyance path; an image forming portion disposed on the first conveyance path and configured to form an image on a sheet; a first conveyance member configured to reverse a sheet received from the first conveyance path; a second conveyance path through which a sheet reversed by the first conveyance member is guided to the first conveyance path; a second conveyance member disposed on the second conveyance path and configured to convey a sheet in a sheet conveyance direction heading to the first conveyance path; a third conveyance member disposed on the second conveyance path, located downstream of the second conveyance member in the sheet conveyance direction, and configured to convey a sheet in the sheet conveyance direction; a fourth conveyance member disposed on the second conveyance path, located downstream of the third conveyance member in the sheet conveyance direction, and configured to convey a sheet to the first conveyance path; a first driving source configured to drive the first and second conveyance members; a second driving source configured to drive the third and fourth conveyance members; a restriction portion capable of restricting driving force of the first driving source from acting on a sheet through the second conveyance member; and a controller configured to control the first and second driving sources so as to execute (i) a first operation in which the second driving source stops driving the third and fourth conveyance members while a first sheet being nipped at the fourth conveyance member and in which a second sheet is conveyed by the second conveyance member to a position where the second sheet abuts with the third conveyance member, and (ii) a second operation, to be executed after the first operation, in which the second driving source starts driving the third and fourth conveyance members in a state where driving force of the first driving source is restricted from acting on the second sheet by the restriction portion.

According to another aspect of the present invention, an image forming apparatus includes: a first conveyance path; an image forming portion disposed along the first conveyance path and configured to form an image on a sheet; a second conveyance path through which a sheet with an image formed by the image forming portion is guided to the first conveyance path; a first conveyance member configured to convey a sheet through the second conveyance path in a sheet conveyance direction heading to the first conveyance path; a second conveyance member disposed on the second conveyance path, located downstream of the first conveyance member in the sheet conveyance direction, and configured to convey a sheet in the sheet conveyance direction; a third conveyance member disposed on the second conveyance path, located downstream of the second conveyance member in the sheet conveyance direction, and configured to convey a sheet in the sheet conveyance direction; a fourth conveyance member disposed on the second conveyance path, located downstream of the third conveyance member in the sheet conveyance direction, and configured to convey a sheet to the first conveyance path; a first driving source configured to drive the first and second conveyance members; a second driving source configured to drive the third and fourth conveyance members; a restriction portion capable of restricting driving force of the first driving source from acting on a sheet through the second conveyance member; and a controller configured to control the first and second driving sources so as to execute (i) a third operation in which the second driving source stops driving the third and fourth conveyance members while a first sheet being nipped at the fourth conveyance member and in which a second sheet is conveyed by the second conveyance member to a position where the second sheet abuts with the third conveyance member, and (ii) a fourth operation, to be executed after the third operation, in which the second driving source starts driving the third and fourth conveyance members in a state where driving force of the first driving source is restricted from acting on the second sheet by the restriction portion, wherein conveyance speeds of the third and fourth conveyance members in the fourth operation are set to be greater than that of the second conveyance member.

Further features of the present invention will become apparent from the following description of exemplary embodiments with reference to the attached drawings.

DESCRIPTION OF THE EMBODIMENTS

Figure 1:
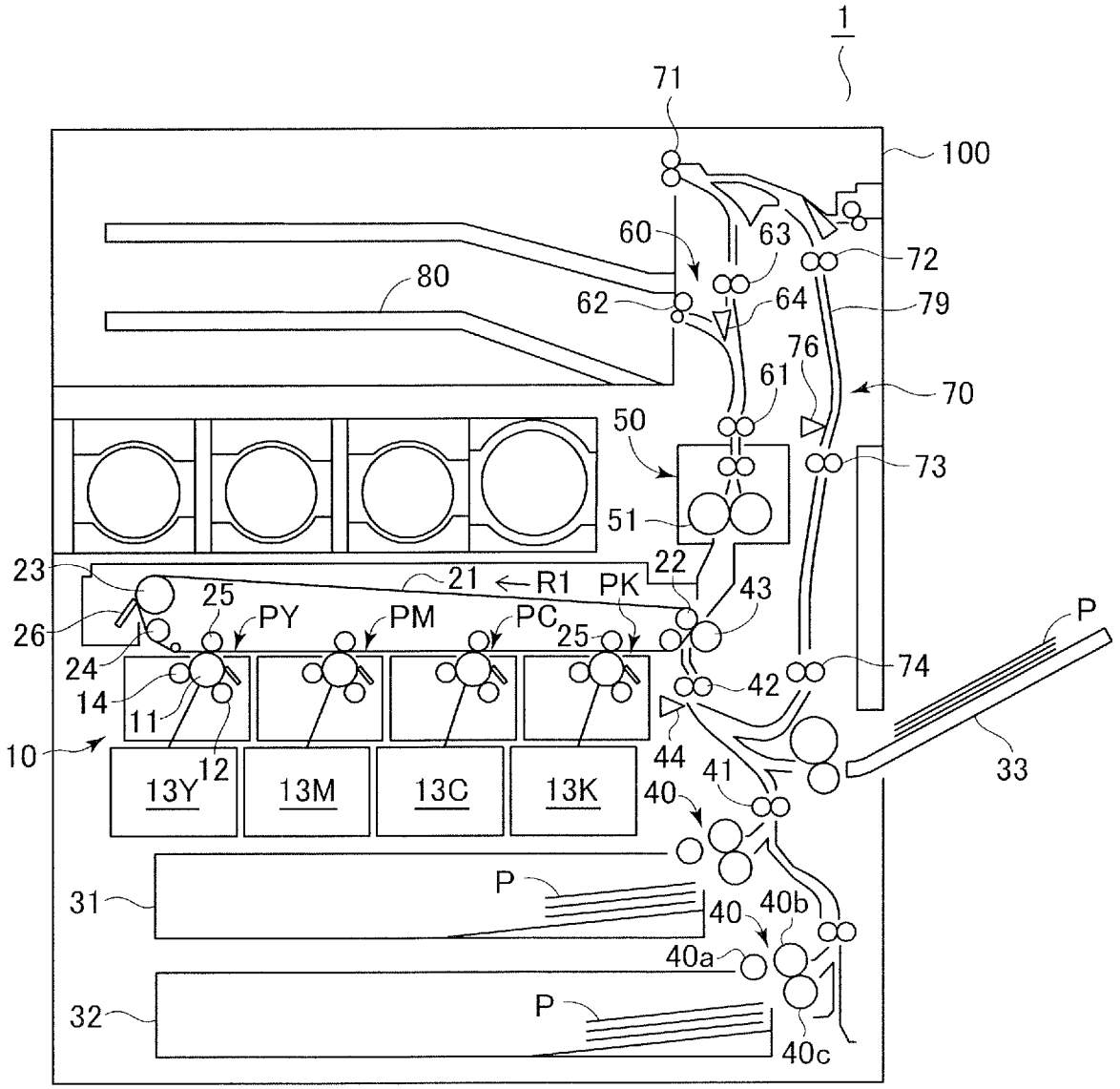
FIG. 1 is a schematic diagram illustrating a configuration of an image forming apparatus of the first embodiment.

An image forming apparatus of the present disclosure will be described below with reference to the drawings. The image forming apparatus may be a printer, a copier, a facsimile machine or a multi-function printer, and is configured to form an image on a sheet used as a recording medium based on image information inputted from an external personal computer or read from a document.

First Embodiment

The image forming apparatus 1 of the present embodiment is an electrophotographic full-color laser printer forming an image on a sheet P used as the recording medium. As for the sheet P, a plain paper, a paper envelope, a coated sheet, plastic film such as an overhead projector sheet and a cloth may be used. An apparatus body 100 of the image forming apparatus 1 is provided with an image forming engine 10 including four image forming portions PY, PM, PC and PK respectively forming toner images of yellow, magenta, cyan and black, and an intermediate transfer belt 21. Each of the image forming portions PY through PK includes a photosensitive drum 11 serving as an image bearing member on which the toner image is formed. The toner images borne on the photosensitive drums 11 are transferred onto the sheet P through the intermediate transfer belt 21 serving as an intermediate transfer body.

Because the image forming portions PY through PK are constructed in the same manner except that colors of toners to be developed are different, the configuration of the image forming portions and a toner image forming process, i.e., an image forming operation, will be described below by exemplifying the yellow image forming portion PY. Beside the photosensitive drum 11, the image forming portion PY includes a charging roller 12 serving as a charging member, an exposure unit 13Y serving as an exposing device, a developing unit 14 serving as a developing device, and a drum cleaner. The photosensitive drum 11 is a drum-like photosensitive member having a photosensitive layer around an outer-circumference thereof and rotates in a direction along a rotational direction R1 of the intermediate transfer belt 21. The charging roller 12 homogeneously charges a surface of the photosensitive drum 11, and the exposure unit 13Y irradiates the surface of the photosensitive drum 11 with a laser beam modulated corresponding to image information Thus, an image writing operation of writing an electrostatic latent image on the surface of the photosensitive drum 11 is executed. The developing unit 14 stores developer containing the toner and develops the electrostatic latent image as a toner image by supplying the toner to the photosensitive drum 11. The toner image formed on the photosensitive drum 11 is primarily transferred onto the intermediate transfer belt 21 by a primary transfer roller 25 serving as a primary transfer device. Residual toner left on the photosensitive drum 11 after the transfer is removed by the drum cleaner.

The intermediate transfer belt 21 is wrapped around a secondary transfer inner roller 22, a stretch roller 23, a tension roller 24 and the primary transfer rollers 25, and is driven to rotate counterclockwise (see arrow R1) in FIG. 1. The image forming operations described above are executed in parallel in the respective image forming portions PY through PK, and the four color toner images are superimposed so as to overlap with each other to form a full-color toner image on the intermediate transfer belt 21. This toner image is borne on the intermediate transfer belt 21 and is conveyed to a transfer portion, i.e., a secondary transfer portion, provided as a nip portion between the secondary transfer inner roller 22 and a secondary transfer roller 43. The secondary transfer roller 43 serving as a transfer member is applied with a bias voltage having an inverse polarity from the charging polarity of the toner to secondarily transfer the toner image borne on the intermediate transfer belt 21 onto the sheet P. Residual toner left on the intermediate transfer belt 21 after the transfer is removed by a belt cleaner 26.

The sheet P onto which the toner image has been transferred is passed to a fixing unit 50. The fixing unit 50 includes a fixing roller pair 51 nipping and conveying the sheet P and including a heat source such as a halogen heater to apply pressure and heat to the toner image borne on the sheet P. Thereby, toner particles melt and adhere to the sheet P, enabling to obtain a fixed image fixed onto the sheet P.

Next, a sheet conveyance operation of the image forming apparatus 1 will be described. The sheet P is stored in a sheet feed cassette 31 or 32 which are drawably mounted in the apparatus body 100. The sheet P stored in the sheet feed cassette 31 or 32 is fed one by one by a feed unit 40. The feed unit 40 includes a pickup roller 40*a* delivering the sheet P out of the sheet feed cassette 31 or 32 and a feed roller 40*b* conveying the sheet P received from the pickup roller 40*a*. The feed unit 40 also includes a separation roller 40*c* separating the sheet P conveyed by the feed roller 40*b* from another sheet P. It is noted that the feed unit 40 described above is one example of a sheet feed unit for feeding the sheet P, and another type sheet feed unit such as a belt-type sheet feeding unit conveying the sheet P by adsorbing to a belt member by a suction fan and a friction separation-type sheet feed unit using a pad may be also used. A user can also set the sheet P directly on a manual feed tray 33 provided on a side of the apparatus body 100, and the sheet P set on the manual feed tray 33 is also fed by the sheet feed unit.

The sheet P delivered out of the feed unit 40 is conveyed to a registration roller pair 42 through a pre-registration roller pair 41. The registration roller pair 42, which is one example of a registration member, corrects a skew of the sheet P by abutting with a leading edge of the sheet P, i.e., a downstream end in a sheet conveyance direction of the sheet P. After that, the registration roller pair 42 sends the sheet P to the secondary transfer portion with timing adjusted with advance of the image forming operation of the image forming portions PY through PK. The sheet P onto which the toner image has been transferred at the secondary transfer portion and the image has been fixed by the fixing unit 50 is passed to a sheet discharge portion 60 wherein the sheet P is conveyed by a post-fixing roller pair 61 toward a change-over member 64 capable of switching a conveyance path of the sheet P.

In a case where the formation of the image onto the sheet P has been completed, the sheet P on which the image has been formed on a first side, i.e., a front side, thereof is discharged onto a discharge tray 80 by the discharge roller pair 62. In a case where an image is to be formed on a second side, i.e., a back side, of the sheet P, the sheet P is passed by the change-over member 64 to a reverse conveyance portion 70 through a conveyance roller pair 63. The reverse conveyance portion 70 includes a reverse conveyance roller pair 71 reversing and conveying, i.e., switching back, the sheet P, and a duplex conveyance path 79 guiding the sheet P switched back by the reverse conveyance roller pair 71 toward the registration roller pair 42. The reverse conveyance roller pair 71 sends the sheet P to the duplex conveyance path 79 by conveying the sheet P in a backward direction after conveying the sheet P toward a discharge space above the discharge tray 80 by a predetermined distance. The duplex conveyance path 79 is provided with a plurality of conveyance roller pairs 72, 73 and 74 as described later in detail to convey the sheet P toward the registration roller pair 42 again. Then, the sheet P onto which the image has been formed on the second side thereof by passing through the second transfer portion and the fixing unit 50 is discharged by the discharge roller pair 62 onto the discharge tray 80.

It is noted that the image forming engine 10 described above is merely one example of the image forming portion and may be also a direct transfer-type engine that directly transfers the toner image formed on the photosensitive member onto a sheet at a transfer portion. An inkjet printing system or an offset printing system may be adopted as an image forming portion.

Figure 2:
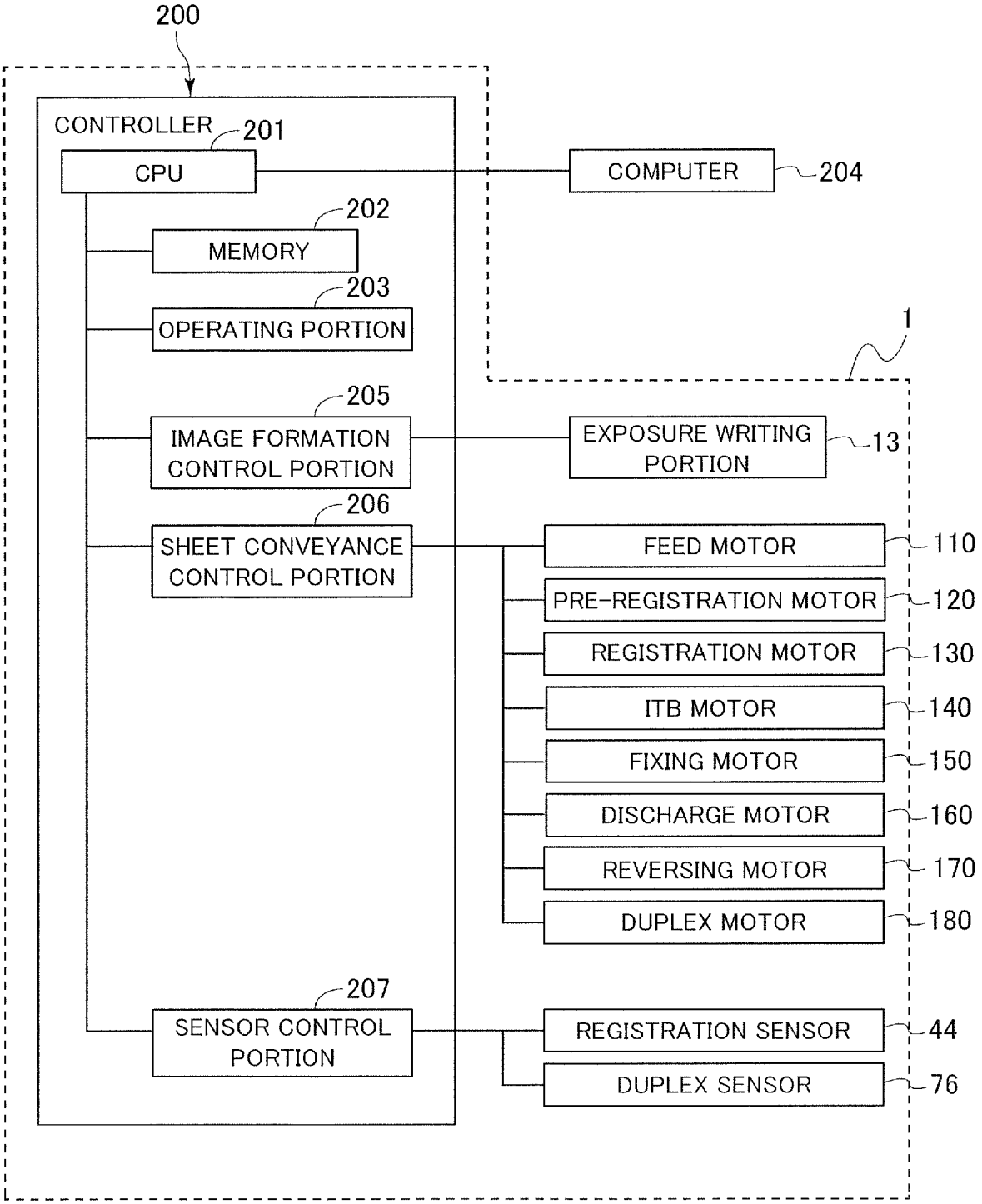
FIG. 2 is a block diagram illustrating a control configuration of the image forming apparatus of the first embodiment.

A control configuration for controlling functions of the image forming apparatus 1 will be described below with reference to a block diagram in FIG. 2. In the image forming apparatus 1, a controller 200 of the present embodiment is mounted. The controller 200 is provided with functioning portions including a central processing unit (CPU) 201, a memory 202, an operating portion 203, an image formation control portion 205, a sheet conveyance control portion 206 and others. The CPU 201 realizes various processing to be executed by the image forming apparatus 1 by reading a control program stored in the memory 202. The memory 202 includes a random access memory (RAM) and a read-only memory (ROM) for example and stores programs and data in predetermined storage areas. The operating portion 203 includes devices such as a liquid crystal panel and buttons and accepts operations performed by a user, such as input of information to be used in printing (e.g., size, grammage, surface nature and others of a sheet), and instructions such as execution of printing and of its interruption.

The image formation control portion 205 controls the image forming operation by giving instructions to respective portions of the image forming engine 10 including an exposure writing portion 13 which commands the exposure units 13Y, 13M, 13C and 13K to perform the image writing operation. The sheet conveyance control portion 206 commands a feed motor 110, a discharge motor 160 and other motors for driving conveyance rollers in order to control conveyance of the sheet P. The sensor control portion 207 controls start and stop of sensing by a registration sensor 44 and a duplex sensor 76 described later and receives detection results of these respective sensors. The controller 200 is also able to receive various information regarding the sheet used for printing from a computer 204 connected with the image forming apparatus 1 through a network.

Sheet Conveyance System

Figure 3:
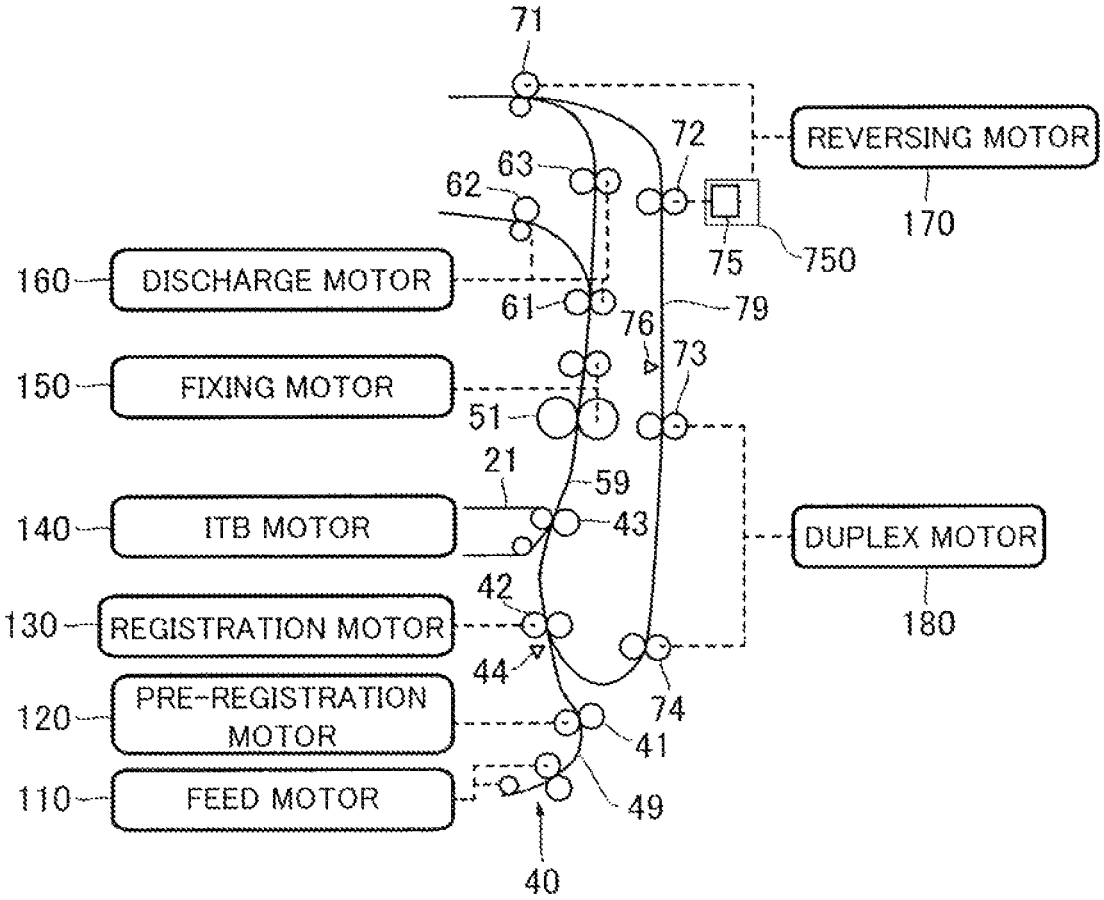
FIG. 3 is a diagram illustrating a driving configuration of a sheet conveyance system of the first embodiment.

Next, the sheet conveyance system and the driving structure controlled by the sheet conveyance control portion 206 of the present embodiment will be described with reference to FIG. 3. The sheet conveyance system provided in the image forming apparatus 1 includes a feed path 49, an image forming path 59 and the duplex conveyance path 79. Sheet conveyance spaces of these paths are defined by guide members supported by the apparatus body 100.

The feed path 49 is a conveyance path for feeding the sheet P and is provided with the feed unit 40 and the pre-registration roller pair 41. The feed unit 40 is driven by the feed motor 110, and the pre-registration roller pair 41 is driven by the pre-registration motor 120.

The image forming path 59 is a conveyance path for forming an image while conveying the sheet P and is provided with the registration roller pair 42, the secondary transfer roller 43, the secondary transfer inner roller 22 and the fixing roller pair 51. The registration roller pair 42 is driven by the registration motor 130, the secondary transfer inner roller 22 is driven by an intermediate-transfer-belt (ITB) motor 140 and the fixing roller pair 51 is driven by a fixing motor 150.

The duplex conveyance path 79 is a conveyance path for conveying the sheet P sent out of the image forming path 59 toward the image forming path 59 again in a case of executing the duplex printing and is provided with a first duplex roller pair 72, a second duplex roller pair 73 and a third duplex roller pair 74. The reverse conveyance roller pair 71 receives the sheet P from the image forming path 59, reverses and sends the sheet P to the duplex conveyance path 79. The first through third duplex roller pairs 72 through 74 are disposed in this order along a direction from the reverse conveyance roller pair 71 to the registration roller pair 42. This direction is referred to as a 'sheet conveyance direction' hereinafter unless specified otherwise.

The reverse conveyance roller pair 71 and the first duplex roller pair 72 are driven by a reversing motor 170, and the second duplex roller pair 73 and the third duplex roller pair 74 are driven by a duplex motor 180. The reversing motor 170 is a motor rotatable in a first (or a normal) direction and in a second (or a reverse) direction opposite from the first direction, and the first duplex roller pair 72 is linked with the reversing motor 170 through a one-way clutch 75 disposed in a drive transmission train 750. The duplex sensor 76 serving as a detector capable of detecting the sheet is disposed between the first duplex roller pair 72 and the second duplex roller pair 73 in the sheet conveyance direction. The registration sensor 44 serving as another detector is disposed at a position in a vicinity of and upstream of the registration roller pair 42. Photoelectric sensors configured to detect a sheet when light is blocked by the sheet may be used for these sensors 44 and 76.

The image forming path 59 is an exemplary first conveyance path on which the image forming portion is disposed. The duplex conveyance path 79 is an exemplary second conveyance path guiding the sheet reversed by the reverse conveyance roller pair 71 or its equivalent toward the first conveyance path. The reverse conveyance roller pair 71 is an exemplary first conveyance member reversing and conveying the sheet from the first conveyance path. The first duplex roller pair 72, the second duplex roller pair 73 and the third duplex roller pair 74 are respective examples of a second conveyance member, a third conveyance member and a fourth conveyance member disposed on the second conveyance path in this order along the sheet conveyance direction. The reversing motor 170 is an exemplary first driving source driving the first and second conveyance members. The duplex motor 180 is an exemplary a second driving source driving the third and fourth conveyance members. The registration motor 130 is an exemplary third driving source driving the registration member.

Besides them, there is provided a discharge motor 160 driving the conveyance roller pairs 61 through 63 composing the sheet discharge portion 60. It is noted that a sheet conveyance operation described below is also applicable to a configuration in which the reverse conveyance roller pair 71 functions also as a discharge member discharging the sheet P, i.e., a configuration in which the sheet discharge portion is omitted.

Waiting State

Next, a case will be described where a sheet is made to wait on the upstream side of a transfer portion, e.g., the secondary transfer portion in the present embodiment, during when duplex printing is executed. In a case of executing the duplex printing on a plurality of sheets, images are basically transferred on the sheets at certain intervals, i.e., at image forming intervals, in accordance to a printing sequence described later. This interval defines the number of sheets outputted per unit time, i.e., productivity of the image forming apparatus. However, because of various reasons as described below, there is a case where an image forming process is temporarily stopped and the image forming interval is prolonged while accepting a drop of the productivity.

For instance, there is a case where conveyance of a sheet to the transfer portion and the fixing unit is stopped to assure a cooling time in a case where temperature of the fixing unit excessively has increased and exceeds a tolerance limit temperature. There is also a case where the image forming process is stopped to wait for a processing operation of a sheet processor, which is attached and connected downstream of the sheet discharge roller and performs a process such as stapling of the sheets. There is also a case where a time, e.g., an image loading time required for the controller of the image forming apparatus to process image data transferred from a computer into a data format supported by the image forming portion (i.e., a data format that can be transferred to the exposure writing portion 13).

When the image forming process is stopped, a new image writing operation is not started in the image forming portions PY through PK, and the sheet P is made to wait on the upstream side of the secondary transfer portion. In a case where the image forming process is delayed by any reason as described above, the controller 200 may determine to delay the image forming process right before the exposure writing portion 13 starts the image writing operation depending on timing when the abovementioned situation occurs. It is noted that from an aspect of improving the productivity of the image forming apparatus 1, a time lag from when the controller 200 determines that the image writing operation can be carried out till when the exposure units 13Y through 13K actually start the image writing operation is shortened as much as possible.

Meanwhile, a time lag from the start of the image writing operation till when the image transfer process on the sheet P is executed depends on a physical structure for conveying the toner image and the sheet P to the secondary transfer portion. For instance, the faster the rotational speed, i.e., a processing speed, of the photosensitive drum 11 and the intermediate transfer belt 21 and/or the shorter a moving distance in which a latent image drawn on the photosensitive drum 11 by the exposure units 13Y through 13K is developed and moved finally to the secondary transfer portion, the smaller the time lag is. In the same time, the larger a conveyance speed of the sheet P and/or the shorter a conveyance distance from the registration roller pair 42 serving as a waiting position of the sheet P to the secondary transfer portion, the shorter the time lag is.

In order to meet the demands for improvement of productivity and for downsizing of the image forming apparatus 1, a distance from the most downstream primary transfer roller in the rotation direction of the intermediate transfer belt 21, i.e., the black transfer roller 25, to the secondary transfer roller 43 is minimized also in the present embodiment. A distance from the registration roller pair 42 to the secondary transfer roller 43 is minimized and is set to be approximately equalized with the distance from the most downstream primary transfer roller 25 to the secondary transfer roller 43.

In a case where the image writing operation of the image forming portions PY through PK is not permitted to start, the sheet P is made to wait at the registration roller pair 42. As soon as the image writing operation is permitted, the electrostatic latent image begins to be drawn and the sheet P begins to be conveyed approximately simultaneously by the registration roller pair 42. Then, the toner image is transferred onto the sheet P at the secondary transfer portion. The timing of starting the image writing operation and the timing of restarting conveyance of the sheet P are controlled so that displacement of the images transferred onto the sheet P does not occur at the secondary transfer portion.

Circulation of Sheets

Figure 4A:
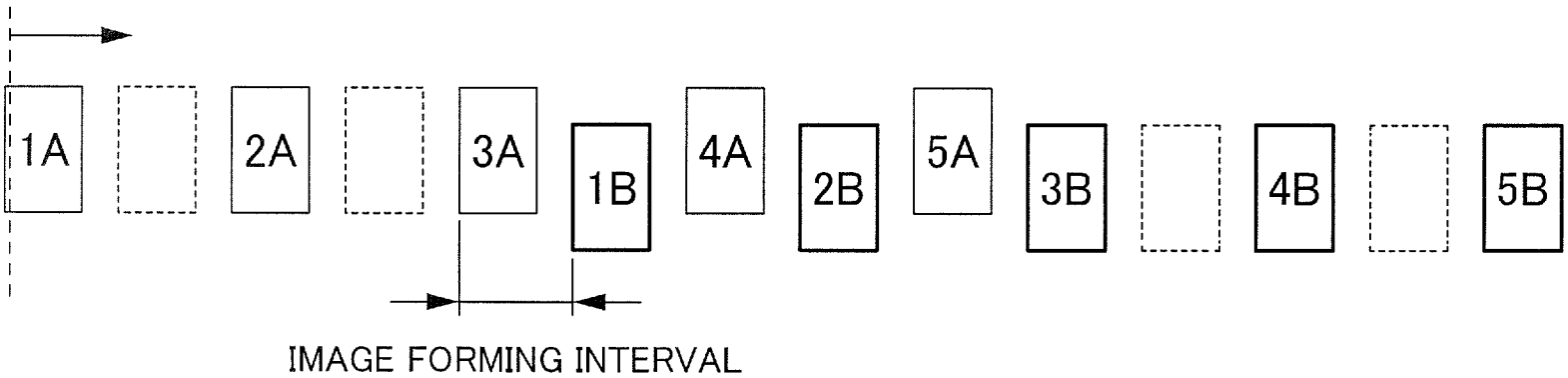
FIG. 4A is a conceptual diagram illustrating an image forming sequence in executing duplex printing on small-size sheets in the first embodiment.
Figure 4B:
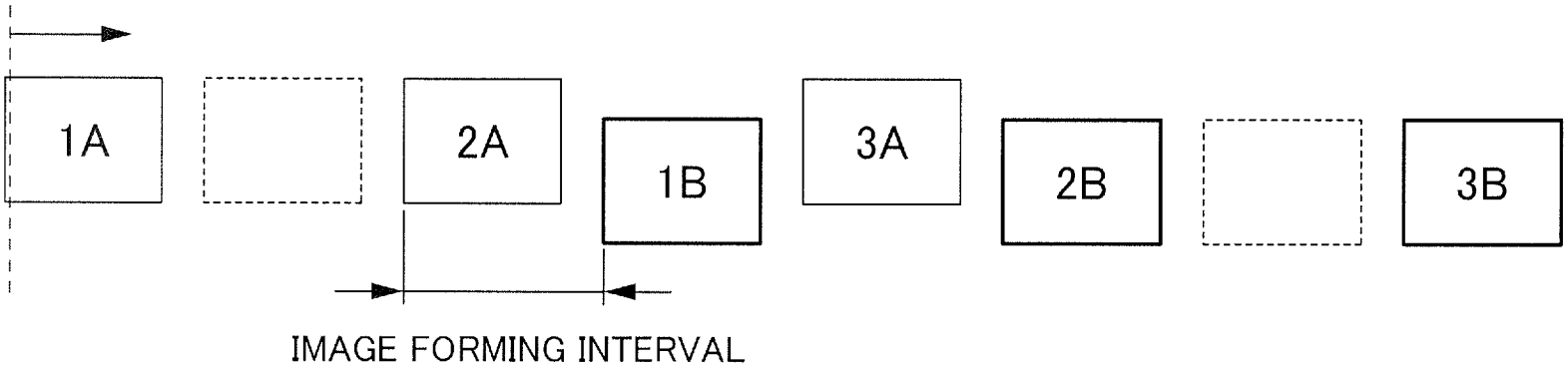
FIG. 4B is a conceptual diagram illustrating an image forming sequence in executing duplex printing on large-size sheets in the first embodiment.
Figure 5A:
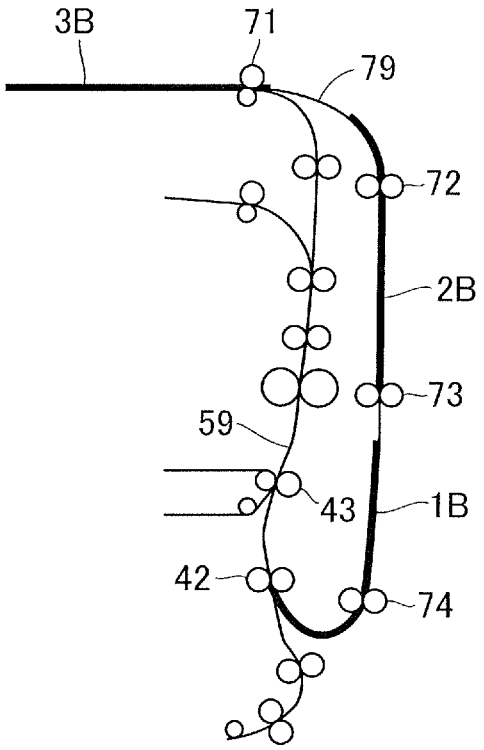
FIG. 5A is a schematic diagram indicating a waiting position in executing the duplex printing on the small-size sheets in the first embodiment.
Figure 5B:
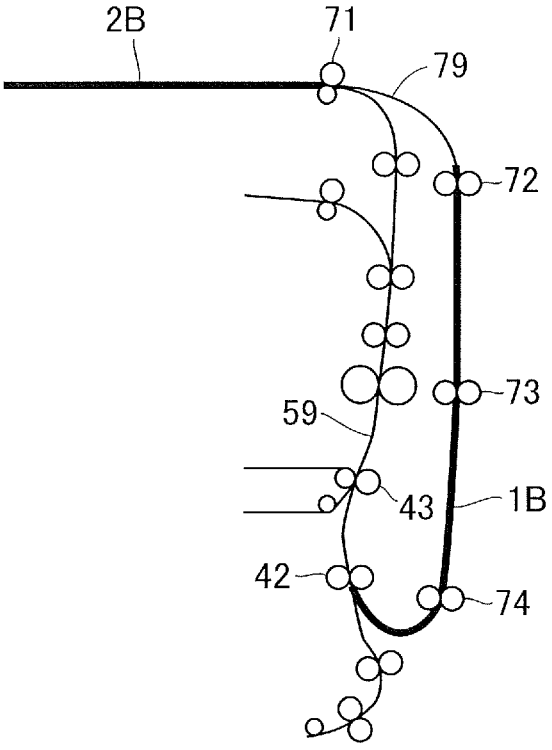
FIG. 5B is a schematic diagram indicating a waiting position in executing the duplex printing on the large-size sheets in the first embodiment.

Next, sheet circulation in the duplex printing will be described. FIGS. 4A and 4B are conceptual diagrams illustrating sequences of executing the image forming operations, and indicate that the images are transferred when passing through the secondary transfer portion (indicated by a broken line) sequentially from sheets on a left side in the diagrams with elapse of time. FIGS. 5A and 5B are schematic diagrams illustrating conditions in which a maximum number of sheets are waiting during the duplex printing. FIGS. 4A and 5A illustrate a case of executing the duplex printing on small-size sheets of which a length in the sheet conveyance direction is relatively small, and FIGS. 4B and 5B illustrate a case of executing the duplex printing on large-size sheets of which a length in the sheet conveyance direction is relatively large. The small-size sheet is exemplified by A4 (210 mm) and Letter (215.9 mm) size sheets, and the large-size sheet is exemplified by A3 (420 mm) and Ledger (431.8 mm) size sheet.

As for reference numerals such as '3A', '1B', the numbers specifies particular sheets, and the alphabet 'A' indicates a condition of the sheet which is not reversed yet and 'B' indicates a condition of the sheet which has been reversed. For instance, '3A' indicates a thirdly fed sheet that is not reversed yet, and '1B' represents a firstly fed sheet which has been reversed.

As illustrated in FIG. 4A, an image is formed on a back side of the first sheet (1B) after sequentially forming images on front sides of three sheets (1A through 3A) in the case of the small-size sheet. After that, the image forming processes on the front side and the back side are alternately executed like (1B, 4A, 2B, 5A, . . . ) and the duplex printing of the five sheets is completed by consecutively forming images on the back sides (3B through 5B) of the final three sheets. In a case where the duplex printing is executed on six or more sheets, a period during which the front side and the back side are alternately printed is extended.

Here, suppose an example case where the waiting process is executed regarding the back side of the first sheet (1B), i.e., a case where the image writing operation as for an image to be printed on the back side of the first sheet (1B) is not permitted to start and the sheet has to wait at the registration roller pair 42. This is a case where an image forming interval between the sheet (3A) and the sheet (1B) is prolonged. In this case, the first sheet (1B) is made to wait abutting with the registration roller pair 42 as illustrated in FIG. 5A. In addition, if a waiting time of the first sheet (1B) is long, the succeeding second and third sheets (2B and 3B) are also needed to wait at any positions on the conveyance path.

That is, in the case of the small-size sheets, up to three sheets may need to be kept waiting. In order to adapt to such a need, the conveyance path from the reverse conveyance roller pair 71 to the registration roller pair 42 through the duplex conveyance path 79 is constructed to have a length capable of accommodating three sheets. It is noted that in a case where the image forming process on the front side of the fifth sheet (5A) is stopped, the sheets that have to wait in the duplex conveyance path 79 are two sheets of the third and fourth sheets (3B and 4B). It is because the first and second sheets (1B and 2B) are discharged out of the image forming apparatus 1.

As described above, there is a case where a go/no-go decision for the image writing operation is made right before when the sheet P arrives at the registration roller pair 42. In this case, after when the first sheet (1B) in the duplex conveyance path 79 is stopped at first, the second sheet (2B) and then the third sheet (3B) are stopped. Therefore, it is necessary to independently control conveyance of the three sheets. In the same time, in order to make the three sheets wait in the conveyance path whose length from the reverse conveyance roller pair 71 to the registration roller pair 42 through the duplex conveyance path 79 is limited, it is required to shorten the intervals between the sheets in the waiting state by stopping conveyance of the succeeding sheet after stopping conveyance of the preceding sheet. It is also possible to improve productivity after restarting conveyance by minimizing the intervals of the sheets in the waiting state as much as possible. Note that it is preferable to make the third sheet (3B) wait at a position fully separated from the image forming path 59 in order to avoid troubles such as deterioration of an image or pasting of the sheets otherwise caused by the heat of the fixing unit. Thus, the third sheet (3B) is made to wait in a condition held by the reverse conveyance roller pair 71 in the present embodiment.

In order to independently control conveyance of such three sheets, it is conceivable to provide three driving sources like motors. In such configuration, each driving source handles one sheet and stops to drive when the sheet arrives at a predetermined sheet position (waiting position). However, it is costly to provide a number of driving sources. Because a cost of motors occupies a significant part of an overall cost of the product, it is preferred to reduce the number of driving sources while assuring the function for achieving cutting down of the cost considerably.

Therefore, the present embodiment adopts a configuration of making a predetermined number of sheets, e.g., three sheets, to wait at desirable positions by a less number of driving sources, e.g., two driving sources, which is less than the predetermined number of sheets. A specific configuration and operations thereof will be detailed later.

By the way, FIGS. 4B and 5B illustrate a case where the image forming apparatus 1 of the present embodiment executes the duplex printing on the large-size sheets. In this case, because a sheet length in the sheet conveyance direction is large, an upper limit of number of sheets that can be made to wait in the conveyance path from the reverse conveyance roller pair 71 to the registration roller pair 42 through the duplex conveyance path 79 is two. For instance, in a case where a waiting process is to be executed on a back side of a first sheet (1B), the first and second sheets (1B and 2B) are put in a waiting state. Here, in order to independently control the two sheets, two or more driving sources such as motors will be enough in principle. That is, because it is just necessary to consider the case where the small-size sheets are made to wait in determining the number of driving sources, the case of conveying the small-size sheets will be described in the following description concerning the sheet conveyance operation.

Sheet Conveyance Operation

A method for conveying sheets will be described below with reference to FIGS. 6A through 10C, in which three sheets are made to wait as necessary by the two driving sources, the reversing motor 170 and the duplex motor 180. FIG. 6A is a flowchart of an overall conveyance operation, and FIG. 6B is a flowchart indicating a processes performed for each sheets.

Figure 6B:
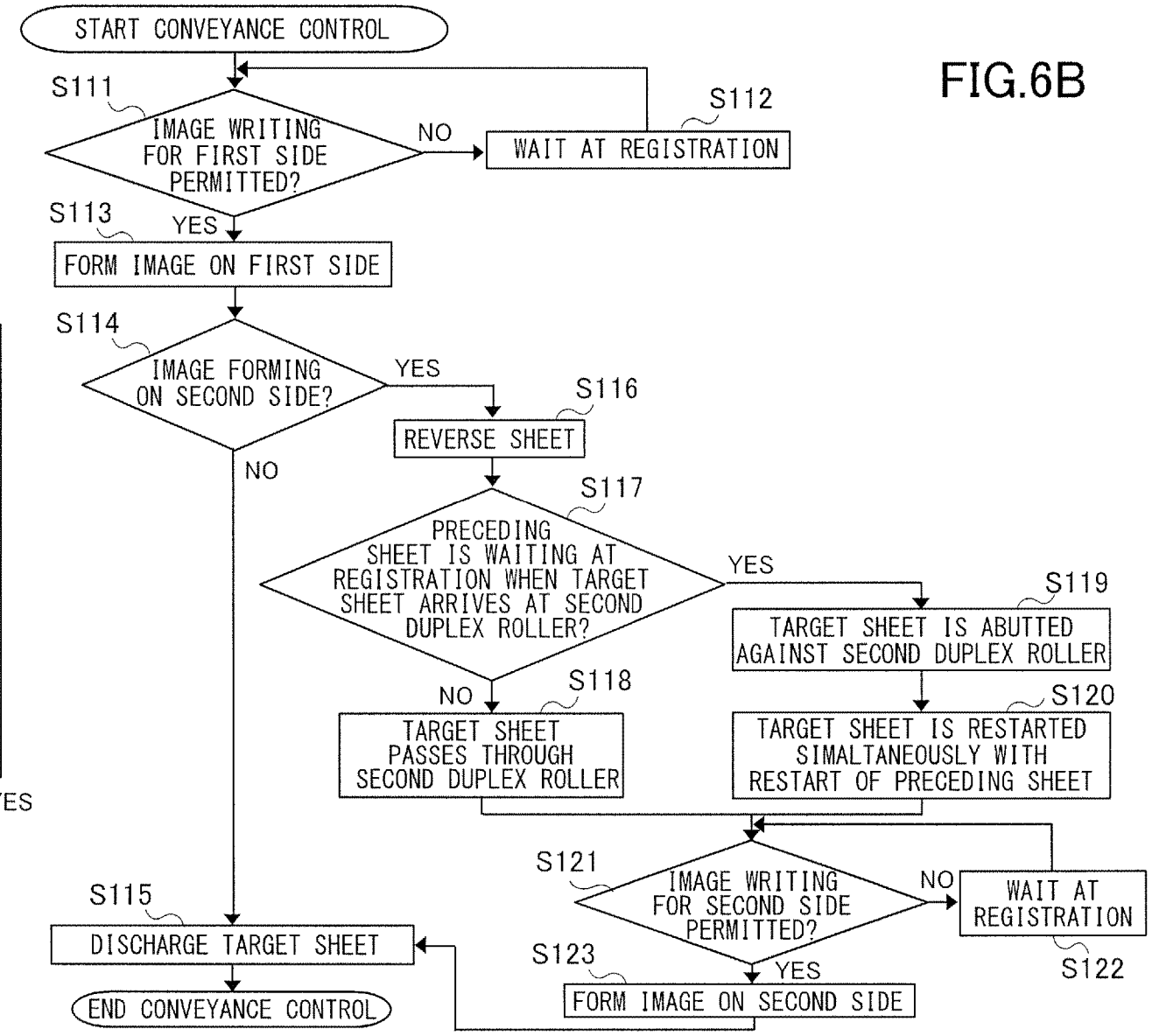
FIG. 6B is a flowchart of a conveyance control performed for each sheet.
Figure 6A:
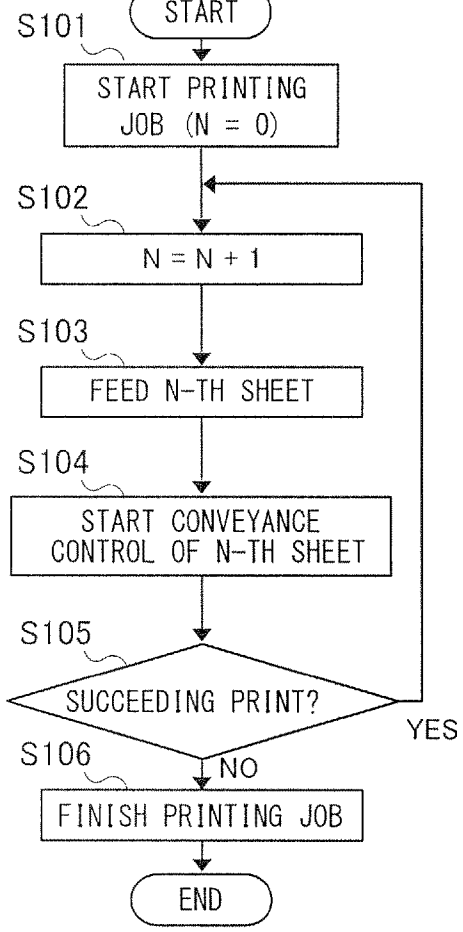
FIG. 6A is a flowchart illustrating an overall flow of a control method for processing a print job in the first embodiment.

Each step of the flowcharts in FIGS. 6A and 6B is achieved by means of the CPU 201 of the controller 200 (see FIG. 2) controlling components of the image forming apparatus 1 through responsible functional blocks such as the image formation control portion 205, the sheet conveyance control portion 206 and the sensor control portion 207. These flowcharts are executed when a user instructs the apparatus to execute a printing job through the operating portion 203 of the image forming apparatus 1 or through the computer 204 connected with the image forming apparatus 1 directly or through a network. A user can specify the number of pages per copy and the number of copies to be printed by the printing job and information of the sheet to be used for printing such as sheet attributes including size and grammage and a cassette as a sheet supply source.

When the controller 200 accepts the printing job and starts the job in Step S101, a sheet is fed sequentially starting with the first sheet (N=1) in Steps S102 and S103. The conveyance operation of each sheet is controlled in Step S104 in accordance to the flowchart in FIG. 6B, by making reference to a condition of a preceding sheet as necessary. It is noted that if the controller 200 is configured to realize the conveyance operation of each sheet in accordance with the flowchart in FIG. 6B, it is not necessary to implement as a parallel processing program. When the number of sheets required in the printing job has been fed and formed the images thereon, i.e., NO in Step S105, the printing job finishes in Step S106.

A control method of the conveyance operation of each sheet will be described below along the flowchart in FIG. 6B. The sheet to be conveyed is referred to as a 'target sheet' hereinafter. When the target sheet is conveyed by the feed unit 40 and the pre-registration roller pair 41 and is detected by the registration sensor 44, a conveyance speed of the target sheet is reduced and it is judged in Step S111 whether the image writing operation can be carried out. If it can, the registration roller pair 42 is started to drive at the time when a leading edge of the target sheet has abutted against the registration roller pair 42 and the target sheet is further conveyed to be flexibly warped into a predetermined level of deflection (a warped portion is also called a "loop"). Thereby, the target sheet is fed to the secondary transfer portion and the image is transferred onto a first side, i.e., the front side, of the target sheet in Step S113. Meanwhile, in a case where it is judged to be unable to start image writing, the pre-registration roller pair 41 is stopped in a condition in which the loop of the target sheet has been formed, and the target sheet is kept waiting until when image writing is permitted in Step S112. It is noted that in the case where the sheet is made to wait, instead of forming the loop before stopping the pre-registration roller pair 41 (during the roller pair 41 is slowing down) as described above, the sheet may be stopped upstream of the registration roller pair 42 and the loop may be formed after restarting the pre-registration roller pair 41.

In a case where it is not necessary to form an image on a second side, i.e., a back side, of the target sheet (No in Step S114), the target sheet is discharged out of the apparatus body 100 by the sheet discharge portion 60 in Step S115. In a case of forming an image on the second side of the target sheet (Yes in Step S114), the target sheet is passed to the reverse conveyance roller pair 71 to perform a reversing operation in Step S116 and is then conveyed to the duplex conveyance path 79. Processes following the reversing operation will be switched, depending on a judgment in Step S117 whether the sheet preceding the target sheet is waiting at the registration roller pair 42 at the timing when the target sheet arrives at the second duplex roller pair 73.

In a case where the preceding sheet is not waiting at the registration roller pair 42 (No in Step S117), a mode of executing no waiting process on the target sheet, i.e., a second mode in the present embodiment, is selected. In this case, the target sheet is passed to the second duplex roller pair 73 being driven, is pulled by the roller pair 73, and is conveyed continuously toward the registration roller pair 42 in Step S118. The target sheet arriving at the registration roller pair 42 waits for a permission of the image writing operation for the target sheet and is conveyed to the secondary transfer portion in Steps S121 and S122 to form the image on the second side in Step S123.

On the other hand, in a case where the preceding sheet is waiting at the registration roller pair 42 (i.e., in a case where the process of Step S122 is being performed on the preceding sheet), a first mode in the present embodiment, in which the waiting process (Step S119) of making the target sheet to wait after the target sheet arriving at a predetermined position, is selected. In this case, the target sheet is conveyed by the first duplex roller pair 72 to a position abutting against the second duplex roller pair 73 that has been stopped. After that, when conveyance of the preceding sheet is restarted by the duplex motor 180 in Step S120, conveyance of the target sheet is also restarted by the second duplex roller pair 73 that is driven by the same duplex motor 180. Then, the target sheet arrives at the registration roller pair 42, waits for image writing for the target sheet being permitted, and is conveyed to the secondary transfer portion in Steps S121 and S122 to form the image on the second side in Step S123.

Behaviors of the sheets and drive controls of the motors, in the cases where the waiting process is/is not executed, will be described below with reference to FIGS. 7A through 11B. It is noted that in the following description, suppose that the succeeding sheet (2B) behaves as the target sheet in the flowchart in FIG. 6B.

Case 1: Waiting Process is not Carried Out

FIGS. 7A and 7B and FIGS. 8A through 8C illustrate the case where no waiting process is executed (No in Step S117), i.e., the case where the image writing operation for the preceding sheet (1B) is permitted before the leading edge of the succeeding sheet (2B) arrives at the second duplex roller pair 73. After being temporarily stopped at a position upstream of the registration roller pair 42, the preceding sheet (1B) is conveyed to the registration roller pair 42 by the third duplex roller pair 74 such that a predetermined interval is kept from the sheet (3A) on which an image is being formed (see FIG. 7A). More specifically, the preceding sheet (1B) is conveyed toward the registration roller pair 42 by the second and third duplex roller pairs 73 and 74 which are driven by the duplex motor 180 with a speed (peripheral speed) of 300 mm/s (See FIG. 8B).

When the registration sensor 44 detects the preceding sheet (1B), the third duplex roller pair 73 is decelerated to a conveyance speed V1 to form a loop, and the preceding sheet (1B) abuts against the registration roller pair 42 and forms the loop. The conveyance speed is V1=220 mm/s, and timing when the driving speed of the duplex motor 180 is decelerated is approximately equal with timing when the go/no-go decision on image writing is made.

Figures 8A, 8B, 8C:
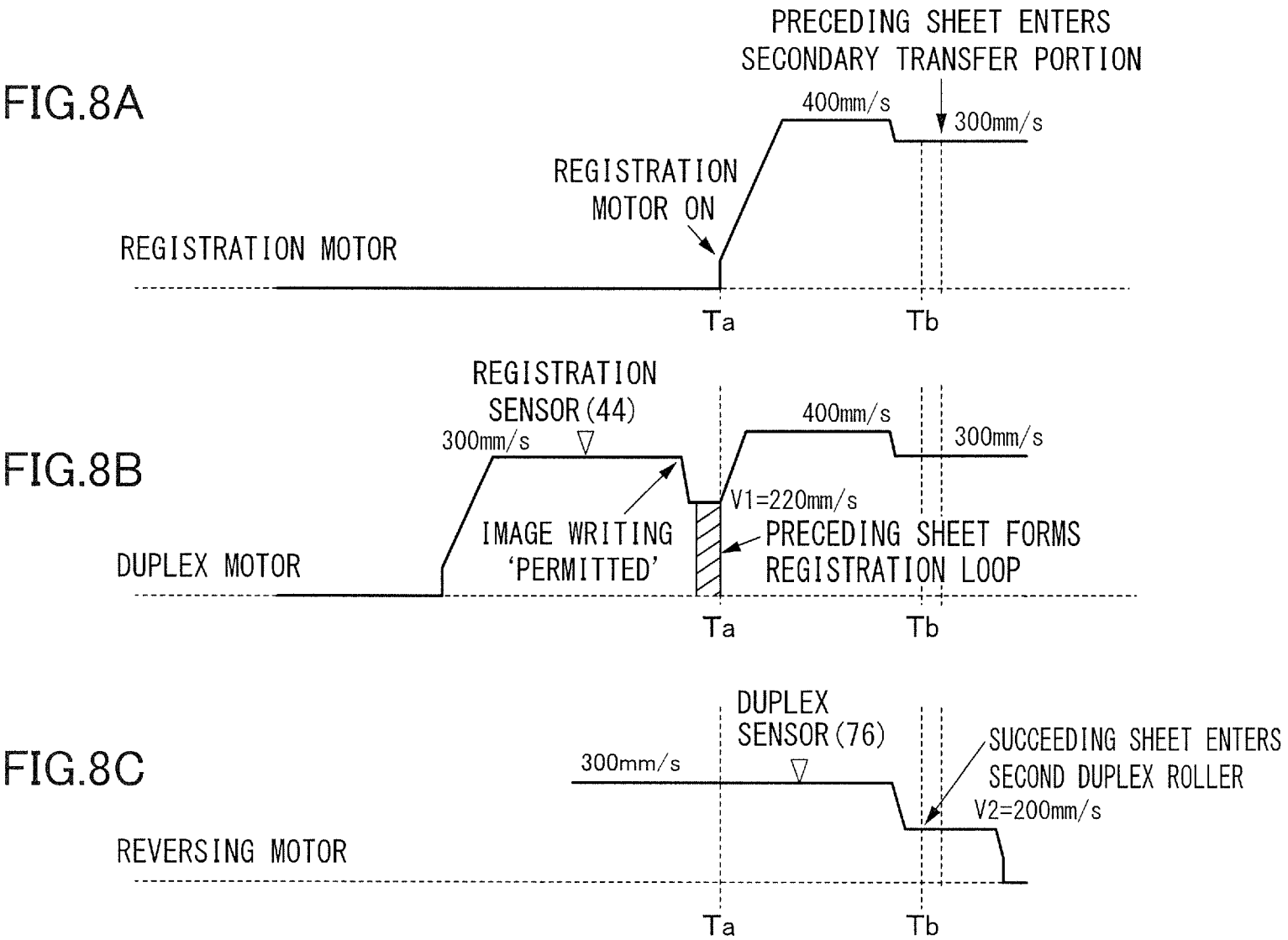
FIG. 8A is a timing chart indicating a driving state of a registration motor in a case where the waiting process is not executed in the first embodiment.
FIG. 8B is a timing chart indicating a driving state of a duplex motor in the same case as FIG. 8A.
FIG. 8C is a timing chart indicating a driving state of a reversing motor in the same case as FIG. 8A.

Because we consider here the case where image writing for the preceding sheet (1B) is permitted before time Tb when the target sheet (2B) arrives at the second duplex roller pair 73, the registration motor 130 is not stopped and is accelerated again in accordance to a drive starting time Ta of the registration motor 130 (see FIGS. 8A and 8B). Here, in order to improve the productivity of the image forming apparatus 1, the conveyance speed of the registration roller pair 42 before a sheet reaches the secondary transfer portion is set to be a value (400 mm/s) larger than a conveyance speed in passing through the secondary transfer portion, i.e., a processing speed (300 mm/s). The duplex motor 180 is accelerated again such that the third duplex roller pair 74 rotates with a peripheral speed of 400 mm/s which is equal with the target speed of the registration roller pair 42 and is decelerated in accordance with the deceleration of the registration motor 130.

Figure 7A:
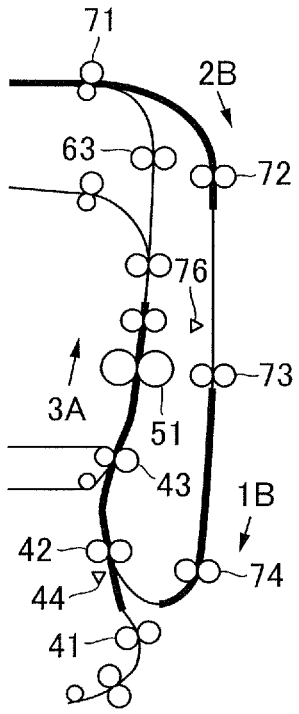
FIG. 7A is a schematic diagram illustrating a duplex printing operation in which a waiting process not is executed in the first embodiment.

Meanwhile, the succeeding sheet (2B) is conveyed with a predetermined speed, e.g., 300 mm/s, succeeding the preceding sheet (1B) by the first duplex roller pair 72 that is driven by the reversing motor 170 rotating reversely (see FIGS. 7A and 8C). After the duplex sensor 76 detects the leading edge of the succeeding sheet (2B), the reversing motor 170 is decelerated such that a conveyance speed V2 of the first duplex roller pair 72 when the succeeding sheet (2B) enters the second duplex roller pair 73 will be 200 (mm/s).

Here, the second duplex roller pair 73 is driven with the conveyance speed (300 mm/s) greater than that of the first duplex roller pair 72. That is, the driving speed (200 mm/s) of the second conveyance member of the first driving source is set to be smaller than the driving speed (300 mm/s) of the third conveyance member in a case where the second sheet is passed from the second conveyance member to the third conveyance member in the present embodiment. Still further, a one-way clutch 75 is provided between the reversing motor 170 and the first duplex roller pair 72. Due to that, when the succeeding sheet (2B) is nipped by the second duplex roller pair 73, the one-way clutch 75 slips and the succeeding sheet (2B) is pulled out of the first duplex roller pair 72 (see FIG. 7B).

Even if a sheet interval is short as compared to those in the timing charts of FIGS. 8A through 8C and the succeeding sheet (2B) is nipped by the second duplex roller pair 73 on the way to form a loop of the preceding sheet (1B), the succeeding sheet (2B) is smoothly pulled out because V2>V1. That is, the succeeding sheet (2B) is passed smoothly even in a condition in which the duplex motor 180 is driven faster than the reversing motor 170, and the preceding sheet (1B) and the succeeding sheet (2B) are conveyed by the driving force of the duplex motor 180.

Figure 7B:
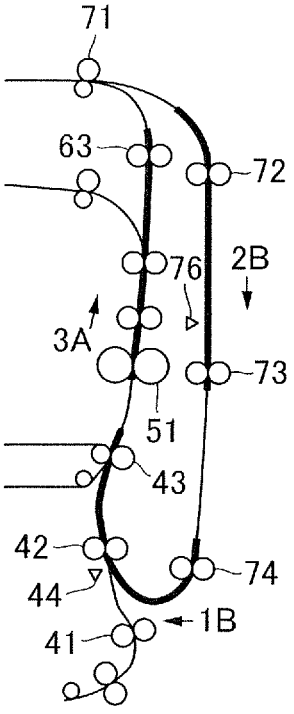
FIG. 7B is another schematic diagram illustrating the duplex printing operation in the first embodiment.

It is noted that even if the reversing motor 170 rotates normally after the succeeding sheet (2B) is passed to the second duplex roller pair 73, no driving force is transmitted to the second duplex roller pair 73 by the action of the one-way clutch 75. Therefore, after when the succeeding sheet (2B) is nipped by the second duplex roller pair 73, pulling of the succeeding sheet (2B) is not hampered even if the reversing motor 170 is normally rotated. Accordingly, this arrangement makes it possible for the reverse conveyance roller pair 71 to start a reverse conveyance by receiving a next sheet (3A) by normally rotating the reversing motor 170 before the next sheet (3A) arrives at the reverse conveyance roller pair 71 as illustrated in FIG. 7B.

Case 2: Waiting Process is Carried Out

Figure 9A:
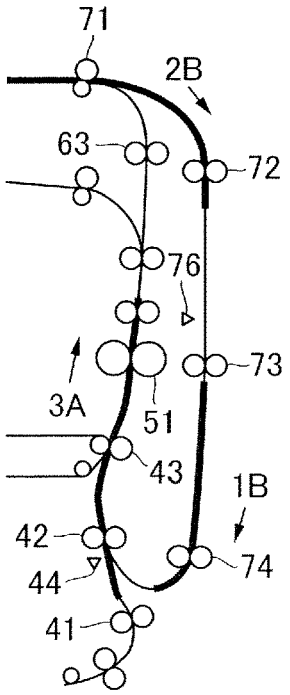
FIG. 9A is a schematic diagram illustrating a step of a duplex printing operation, in which the waiting process is executed, in the first embodiment.

Next, operations in the case where the waiting process is executed will be described. FIGS. 9A through 9D illustrate a case where a result of Step S117 in FIG. 6B is Yes, i.e., a case where image writing for the preceding sheet (1B) is permitted after the leading edge of the succeeding sheet (2B) arrived at the second duplex roller pair 73. FIG. 9A illustrates a condition, identical to FIG. 7A, in which the preceding sheet (1B) is conveyed by the third duplex roller pair 74 toward the registration roller pair 42 with a predetermined speed (300 mm/s). Still further, the reversing motor 170 is reversely driven, and the succeeding sheet (2B) is conveyed by the first duplex roller pair 72 with a predetermined speed (300 mm/s).

Figure 9B:
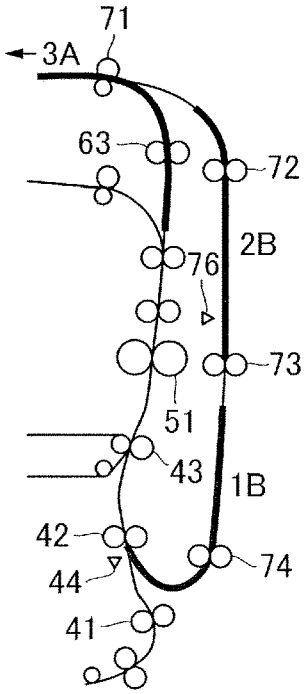
FIG. 9B is a schematic diagram illustrating a step following FIG. 9A.
Figure 9C:
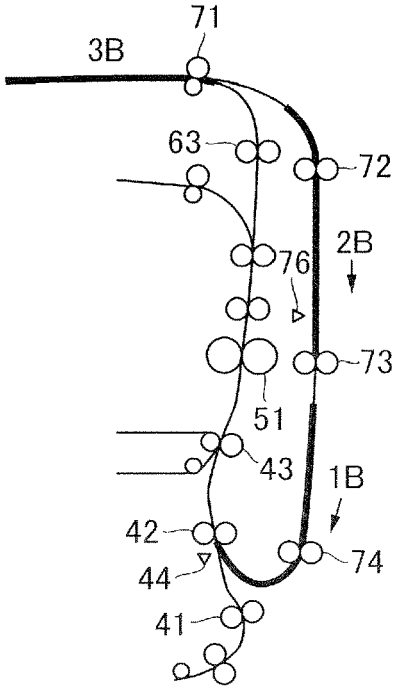
FIG. 9C is a schematic diagram illustrating a step following FIG. 9B.
Figure 9D:
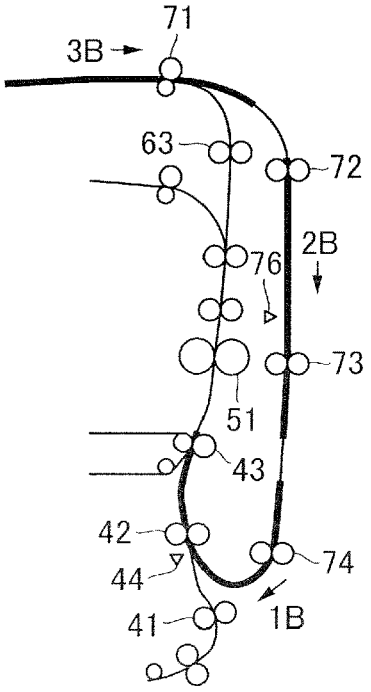
FIG. 9D is a schematic diagram illustrating a step following FIG. 9C.

Here, suppose that go/no-go decision on image writing for the preceding sheet (1B) is No at the timing Tb when the succeeding sheet (2B) arrives at the second duplex roller pair 73 as illustrated in FIG. 9B. In this case, the duplex motor 180 is stopped in a condition in which the preceding sheet (1B) is nipped by the third duplex roller pair 74 and the leading edge of the preceding sheet (1B) is abutted against the registration roller pair 42 while forming a loop (see FIG. 10B).

After the duplex sensor 76 detected the leading edge of the succeeding sheet (2B), the reversing motor 170 is decelerated such that a conveyance speed V2 of the first duplex roller pair 72 when the succeeding sheet (2B) is nipped by the second duplex roller pair 73 will be 200 mm/s. Because the duplex motor 180 has stopped driving the second duplex roller pair 73, the leading edge of the succeeding sheet (2B) is abutted against the second duplex roller pair 73. The reversing motor 170 is stopped in a condition in which the succeeding sheet (2B) is abutted against the second duplex roller pair 73 while forming a loop.

Figures 10A, 10B, 10C:
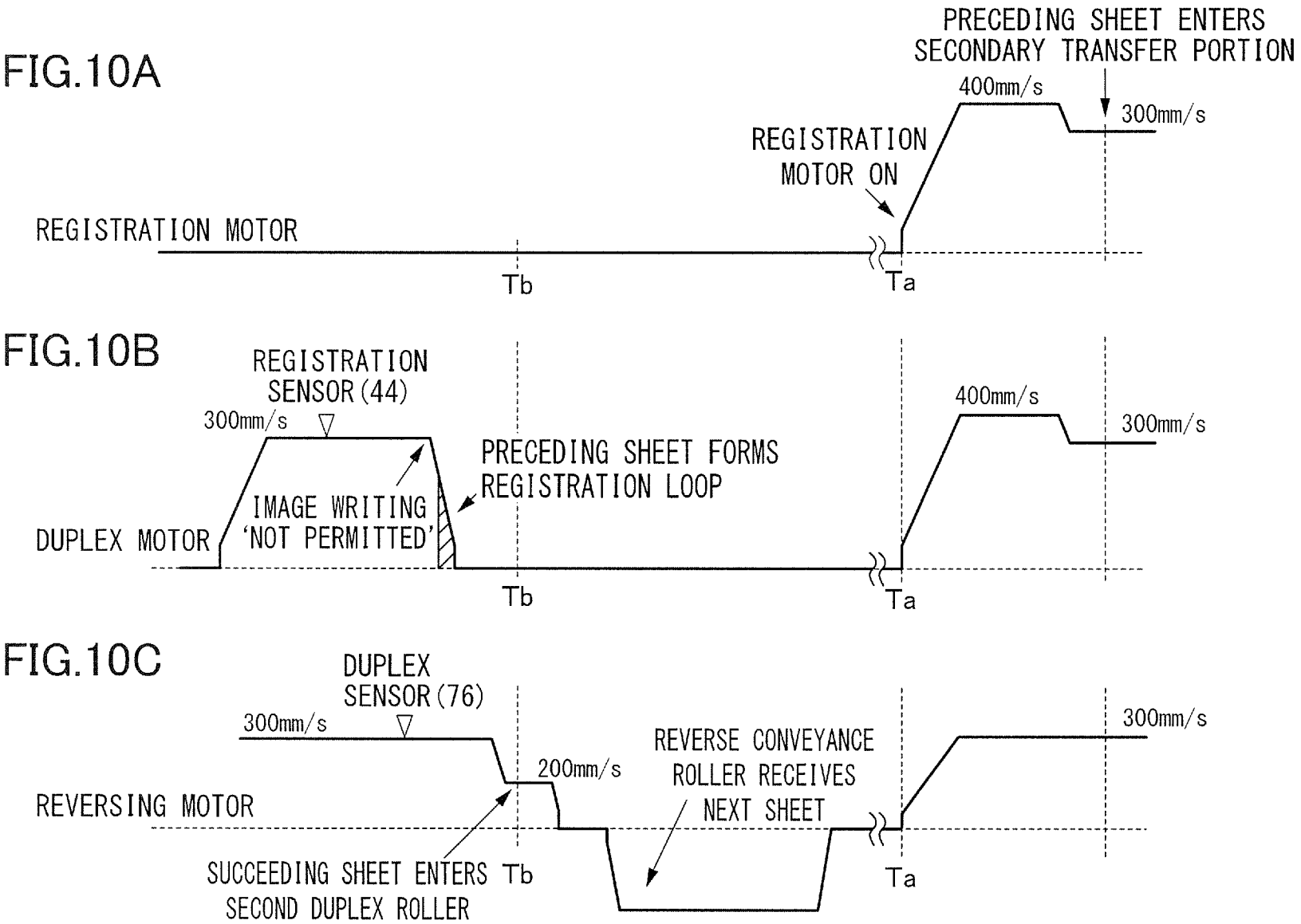
FIG. 10A is a timing chart indicating a driving state of the registration motor in a case where the waiting process is executed in the first embodiment.
FIG. 10B is a timing chart indicating a driving state of the duplex motor in the same case as FIG. 10A.
FIG. 10C is a timing chart indicating a driving state of the reversing motor in the same case as FIG. 10A.

Here, because the one-way clutch 75 is disposed between the reversing motor 170 and the first duplex roller pair 72, reverse conveyance of the next sheet (3A) can be started further in a state where the succeeding sheet (2B) is kept waiting (see FIG. 9B). That is, after the succeeding sheet (2B) is abutted against the second duplex roller pair 73, the second duplex roller pair 73 can pull out the succeeding sheet (2B) even if the reversing motor 170 is stopped or switched to normal rotation. Therefore, the reverse conveyance roller pair 71 can receive the next sheet (3A) by normally rotating the reversing motor 170 after the succeeding sheet (2B) arrived at the waiting position (FIG. 10C). It is noted that in FIG. 10C, the sheet conveyance direction in the duplex conveyance path 79 is indicated as a positive conveyance speed, and a conveyance direction before the reverse conveyance roller pair 71 reverses a sheet is indicated as a negative conveyance speed. The reversing motor 170 stops the reverse conveyance roller pair 71 when the next sheet (3A) reaches a predetermined waiting position, i.e., a position where the sheet (3A) should be switched back (see FIG. 9C).

Thus, up to three sheets (1B, 2B and 3B) can be made to wait in the reverse conveyance portion 70 in a case where there is a long waiting time before image writing for the preceding sheet (1B) is permitted. Then, the duplex motor 180 starts to be driven at the timing (Ta) when image writing for the preceding sheet (1B) is permitted, and conveyance of the succeeding sheet (2B) is started again together with the preceding sheet (1B) (see FIGS. 9C and 9D).

Figure 11A:
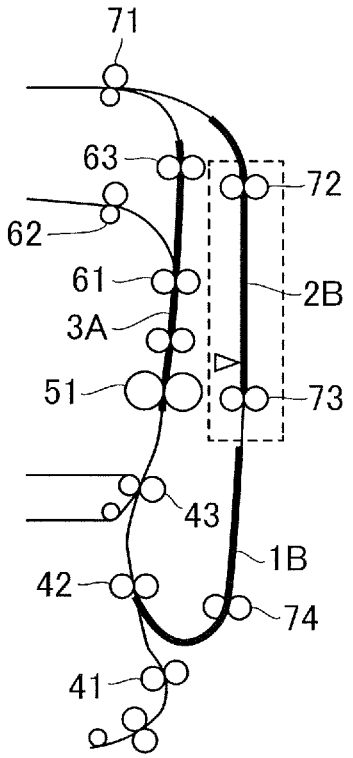
FIG. 11A is a schematic diagram illustrating a succeeding sheet abutted against a second duplex roller pair in the first embodiment.

Here, abutting state of the succeeding sheet abutted against the second duplex roller pair 73 will be described with reference to FIGS. 11A and 11B. FIG. 11A is a schematic diagram illustrating the abutting state in which the succeeding sheet (2B) is abutted against the second duplex roller pair 73 and in which the reversing motor 170 has been stopped by the waiting process, and FIG. 11B is an enlarged view of an area indicated by a broken line in FIG. 11A.

Figure 11B:
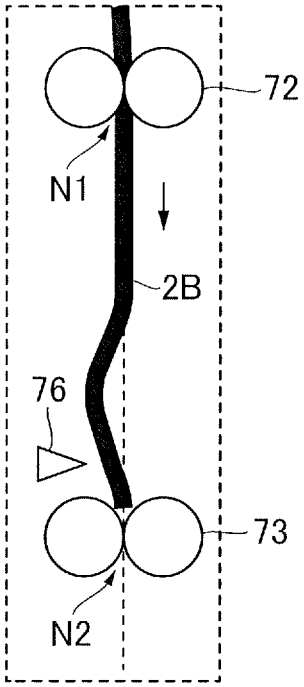
FIG. 11B is an enlarged view of a part of FIG. 11A.

As illustrated in FIG. 11B, the reversing motor 170 drives the first duplex roller pair 72 such that the succeeding sheet (2B) is conveyed to a position where the leading edge of the succeeding sheet (2B) abuts against a nip portion N2 of the second duplex roller pair 73 and the succeeding sheet (2B) is flexibly warped (i.e., a position where the succeeding sheet (2B) forms a loop). That is, the reversing motor 170 is controlled after the duplex sensor 76 detected the succeeding sheet (2B) such that the second duplex roller pair 73 conveys the succeeding sheet (2B) by a predetermined amount even after the leading edge of the succeeding sheet (2B) has arrived at the second duplex roller pair 73. Being nipped at a nip portion N1 of the first duplex roller pair 72 when the loop has been formed, such force acts on the succeeding sheet (2B) that its leading edge is forced into the nip portion N2 of the second duplex roller pair 73. Therefore, when the second duplex roller pair 73 is started to be driven by the duplex motor 180, the succeeding sheet (2B) is firmly nipped by the second duplex roller pair 73 and its conveyance is restarted together with the preceding sheet (1B).

As described above, in the case where the preceding sheet (1B) is waiting, the succeeding sheet (2B) is conveyed to the waiting position where conveyance of the succeeding sheet (2B) is automatically restarted by restarting the duplex motor 180. In other words, the first operation (Step S119) in which the second driving source (180) is stopped with a first sheet (1B) being nipped at the fourth conveyance member (74) and in which a second sheet (2B) is conveyed by the second conveyance member (72) to a position where the second sheet (2B) abuts with the third conveyance member (73). Therefore, by performing the second operation (Step S120) in which the second driving source starts driving the third and fourth conveyance members after the first operation, it becomes possible to restart conveyance of the first and second sheets having been in the waiting state.

Meanwhile, because the present embodiment is configured such that a restriction, i.e., the one-way clutch portion (75), restricts driving force of the first driving source (170) from acting on the second sheet through the second conveyance member (72), it is possible to independently control conveyance of the third sheet in a state where the first and second sheets are kept waiting. That is, the first conveyance member (71) can receive the third sheet (3A) driven by the first conveyance member in a state where driving force of the first driving source is restricted from acting on the second sheet. This configuration realizes that, using the two motors, three sheets can be made to wait and conveyance thereof are restarted as necessary. Therefore, the present embodiment makes it possible to cut the production cost by reducing the number of the motors without reducing the number of sheets that can be circulated in the duplex printing operation.

It is noted that while the case where all of the three sheets are made to wait has been described above with reference to FIGS. 9A through 9D and FIGS. 10A through 10C, the next sheet (3A) may be made not to wait in a case where image writing for the preceding sheet (1B) is permitted before the next sheet (3A) arrives at the waiting position. In this case, the next sheet (3A) is reversed and conveyed by the reverse conveyance roller pair 71 to the duplex conveyance path 79 without stopping the reversing motor 170. In other words, the configuration of the present embodiment makes it possible to drive the first conveyance member by the first driving source to start to convey the third sheet while executing the second operation (i.e., in a state where the second sheet is being pulled out of the second conveyance member).

Modified Examples

Figure 13:
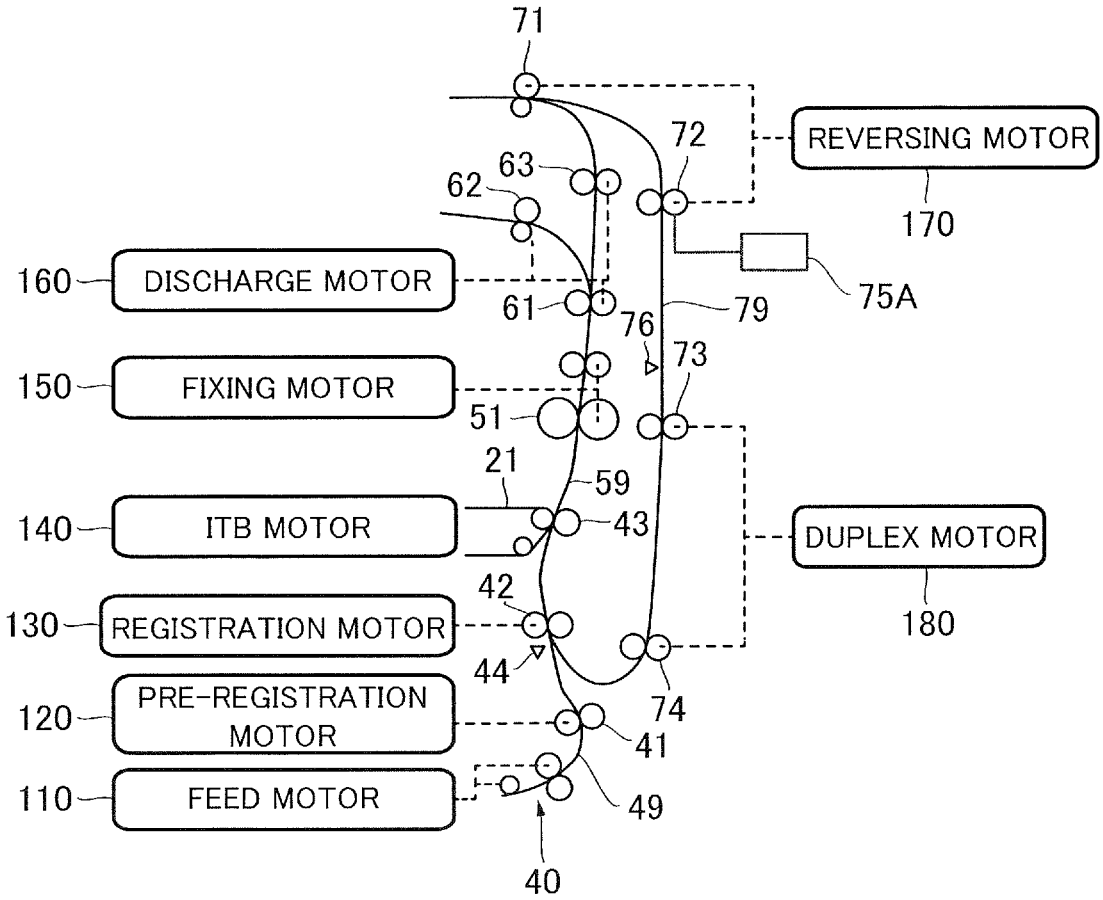
FIG. 13 is a diagram illustrating a driving configuration of a sheet conveyance system of the first embodiment, having an alternative cam mechanism.

While the one-way clutch 75 is used as a restriction portion that can restrict the driving force of the first driving source from acting on a sheet through the second conveyance member, it may be replaced with another clutch mechanism such as a dog clutch capable of engaging/disengaging drive transmission. Another mechanism 75A capable of switching the second duplex roller pair 73 between an abutment state of forming a nip for nipping a sheet and a separate state of not forming the nip, such as a cam mechanism linked to shaft(s) of the roller pair and changing a distance between axes of the roller pair, may also be used as illustrated in FIG. 13.

Still further, while conveyance of the succeeding sheet (2B) is stopped in the condition in which the leading edge of the succeeding sheet (2B) is made to abut against the second duplex roller pair 73 and to form a loop, the sheet (2B) may be stopped at timing when the leading edge of the sheet (2B) arrives at a nip position of the second duplex roller pair 73, supposing that accuracy of a conveyance distance is assured. It is noted that, however, stability in sheet conveyance will be improved by forming a loop like the present embodiment to alleviate variation of sheet position caused by fluctuation of conveyance speed. A preferable feed amount for forming the loop was 5 mm, for example. Conveyance guides of the duplex conveyance path 79 that defines a space in which the loop is formed were also curved to assure an adequate loop space permitting the loop of the sheet so as to reduce stress applied on the sheet.

In the above-described embodiment, a sheet to be made to wait at the second duplex roller pair 73 is conveyed and brought into contact with the roller pair 73 such that the leading edge of the sheet is abutted against the roller pair 73. However, the sheet may be brought into contact with the roller pair 73 without forming a loop. For instance, the sheet may be brought into contact with the second duplex roller pair 73 by entering the nip portion of the roller pair 73 due to stiffness of the sheet. A clutch mechanism such as a one-way clutch may be also disposed in a drive transmission train from the duplex motor 180 to the second duplex roller pair 73. With this configuration, because of the action of the clutch mechanism, the leading edge of the sheet will reliably enter the nip portion of the second duplex roller pair 73 to be in contact with the roller pair 73 due to stiffness of the sheet.

Still further, while the present embodiment has been configured such that each of the reversing motor 170 and the duplex motor 180 drive two roller pairs, it is also possible to configure such that one or both of the motors drive three roller pairs or more. For instance, a roller pair may be added between the second duplex roller pair 73 and the third duplex roller pair 74 or a roller pair may be added between the reverse conveyance roller pair 71 and the first duplex roller pair 72. It is noted that an additional restriction portion such as a one-way clutch is required in a case of adding a roller pair at a position at which a sheet in the waiting state and to be pulled out by the second duplex roller pair 73 is held.

The method for controlling driving speed of the motors and the specific speeds as described above with reference to FIGS. 8A through 8C and FIGS. 10A through 10C may be changed as necessary. For instance, while the present embodiment is configured such that the drive of registration motor 130 is started without stopping that of the duplex motor 180 in a case where there is not necessity for a sheet to wait at the registration roller pair 42 (see FIG. 8B), drive of the duplex motor 180 may be temporarily stopped after forming a loop.

Still further, while the present embodiment adopts the motors 170 and 180 as the driving sources, an actuator other than motors may be adopted as the first and second driving sources. For instance, it is possible to arrange a single motor, which is connected to both of a train for transmitting driving force to the reverse conveyance roller pair 71 and the first duplex roller pair 72 and a train 750 for transmitting driving force to the second duplex roller pair 73 and the third duplex roller pair 74. In that case, each of drive transmission members, of which driving states can be independently controlled by an electromagnetic clutch or the like, serves as a driving source.

Second Embodiment

Next, an image forming apparatus of the second embodiment will be described with reference to FIG. 12. According to the present embodiment, it is possible to make four or more sheets, i.e., more sheets than in the first embodiment, to wait on a conveyance path for reversing and conveying the sheets again to the image forming portion. It is noted that although directions of the sheet conveyance paths and disposition of members composing the image forming apparatus are different from those of the first embodiment, a basic image forming process is common. Therefore, members having the same functions with those of the first embodiment will be denoted by the same reference numerals and their description will be omitted here.

Figure 12:
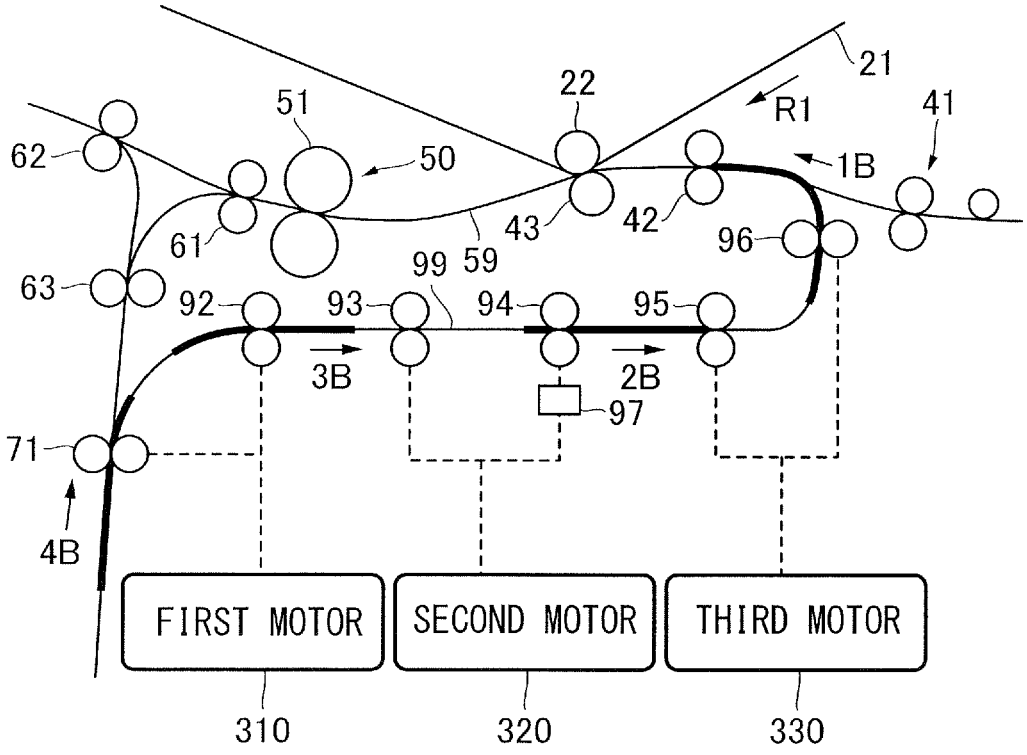
FIG. 12 is a schematic diagram of an image forming apparatus of the second embodiment.

As illustrated in FIG. 12, the image forming apparatus of the present embodiment includes an image forming path 59 serving as a first conveyance path along which the image forming portion 20 is disposed and a duplex conveyance path 99 serving as a second conveyance path guiding the sheet that has passed through the image forming path 59 again to the image forming path 59. Disposed along the duplex conveyance path 99 are a first conveyance roller pair 92, a second conveyance roller pair 93, a third conveyance roller pair 94, a fourth conveyance roller pair 95 and a pre-registration roller pair 96 in this order in a sheet conveyance direction heading toward the registration roller pair 42. The duplex conveyance path 99 has a path length longer than that of the first embodiment and capable of accommodating four sheets in the path from the reverse conveyance roller pair 71 to the fourth conveyance roller pair 95.

The reverse conveyance roller pair 71 and the first conveyance roller pair 92 are driven by a first motor 310. The second conveyance roller pair 93 and the third conveyance roller pair 94 are driven by a second motor 320. The fourth conveyance roller pair 95 and the pre-registration roller pair 96 are driven by a third motor 330. A one-way clutch 97 serving as a restriction portion is disposed in a transmission train from the second motor 320 to the third conveyance roller pair 94.

A series of operations for making second to fourth sheets to wait in a case where a first sheet (1B) is kept waiting at the registration roller pair 42 will be described below. In a case where image writing for the first sheet (1B) is not permitted, the sheet (1B) is made to wait with a leading edge thereof abutted with the registration roller pair 42 and the sheet being nipped by the pre-registration roller pair 96. In a case of making the second sheet (2B) to wait in this condition, the second motor 320 is stopped after when the sheet (2B) is conveyed by the third conveyance roller pair 94 to a position abutting with the fourth conveyance roller pair 95. In a case where it is necessary to make more sheets to wait, the first motor 310 is stopped when the third sheet (3B) is nipped by the first conveyance roller pair 92 and the fourth sheet (4B) is also nipped by the reverse conveyance roller pair 71.

When the image writing operation for the first sheet (1B) is permitted in a condition in which the four sheets are waiting, the pre-registration roller pair 96 and the fourth conveyance roller pair 95 are started to rotate by the third motor 330. Thereby, conveyance of the first and second sheets (1B and 2B) is started again. Then, the respective roller pairs are started to be driven by the first and second motors 310 and 320, conveyance of the third and fourth sheets (3B and 4B) is started again toward the registration roller pair 42.

Thus, an operation (i.e., a third operation) in which the second driving source (330) stops driving the third and fourth conveyance members (95 and 96) with a first sheet (1B) being nipped at the fourth conveyance member (96) and in which a second sheet (2B) is conveyed to a position where the second sheet (2B) is brought into contact with the third conveyance member (95). Accordingly, conveyance of the first and second sheets being in the waiting state can be started by executing an operation (i.e., a fourth operation), in which the second driving source starts driving the third and fourth conveyance members, after the third operation.

Meanwhile, because the present embodiment is configured such that a restriction portion (94) restricts driving force of the first driving source (320) from acting on the second sheet through the second conveyance member (94), it is also possible to independently control conveyance of the third sheet in a state where the first and second sheets are kept waiting. That is, the first driving source is controlled so as to drive the first conveyance member (93) in a state where driving force of the first driving source is restricted from acting on the second sheet, so that the first conveyance member can receive the third sheet (3B) to start conveyance. This configuration realizes that, using the two motors, three sheets can be made to wait and conveyance thereof are restarted as necessary. Therefore, the present embodiment also makes it possible to cut the production cost by reducing the number of the motors without reducing the number of sheets that can be circulated in the duplex printing operation.

According to the present embodiment, a conveyance speed of the registration roller pair 42 before the sheet (1B) arrives at the secondary transfer portion is set to be greater than the processing speed at the secondary transfer portion (see FIG. 10A of the first embodiment). Here, even if the third motor 330 is accelerated in accordance to the conveyance speed of the registration roller pair 42, and if the conveyance speed of the fourth conveyance roller pair 95 becomes greater than that of the third conveyance roller pair 94, the sheet (2B) is smoothly conveyed as the one-way clutch 97 slips. In addition, it is possible to simplify control configuration for the second motor 320 because the second motor 320 needs not be accelerated or decelerated in accordance to the registration roller pair 42 and may be driven always at a constant speed for example.

It is noted that while the one-way clutch 97 is disposed between the second motor 320 and the third conveyance roller pair 94 in the present embodiment, the one-way clutch may be disposed between the first motor 310 and the first conveyance roller pair 92 instead. In this case, it is possible to execute the same operation with the first embodiment except that the number of sheets to be made to wait. Still further, one-way clutches may be disposed also between the second motor 320 and the third conveyance roller pair 94 and between the first motor 310 and the first conveyance roller pair 92, respectively. Still further, although the case of four sheets has been exemplified as the number of sheets that can be made to wait in the present embodiment, it is possible to achieve both reduction of number of driving sources and improvement of productivity by a similar configuration even if the number of sheets made to wait is five or more.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-171596, filed on Sep. 6, 2017, which is hereby incorporated by reference herein in its entirety.

What is claimed is:

1. An image forming apparatus comprising:

a first conveyance path;

an image forming portion disposed on the first conveyance path and configured to form an image on a sheet;

a first conveyance member configured to reverse a sheet received from the first conveyance path;

a second conveyance path through which a sheet reversed by the first conveyance member is guided to the first conveyance path;

a second conveyance member disposed on the second conveyance path and configured to convey a sheet in a sheet conveyance direction heading to the first conveyance path;

a third conveyance member disposed on the second conveyance path, located downstream of the second conveyance member in the sheet conveyance direction, and configured to convey a sheet in the sheet conveyance direction;

a fourth conveyance member disposed on the second conveyance path, located downstream of the third conveyance member in the sheet conveyance direction, and configured to convey a sheet to the first conveyance path;

a first driving source configured to drive the first and second conveyance members;

a second driving source configured to drive the third and fourth conveyance members;

a restriction portion capable of restricting driving force of the first driving source from acting on a sheet through the second conveyance member; and a controller configured to control the first and second driving sources so as to execute (i) a first operation in which the second driving source stops driving the third and fourth conveyance members while a first sheet being nipped at the fourth conveyance member and in which a second sheet is conveyed by the second conveyance member to a position where the second sheet abuts with the third conveyance member, and (ii) a second operation, to be executed after the first operation, in which the second driving source starts driving the third and fourth conveyance members in a state where driving force of the first driving source is restricted from acting on the second sheet by the restriction portion.

2. The image forming apparatus according to claim 1, wherein the restriction portion comprises a clutch mechanism disposed in a drive transmission train from the first driving source to the second conveyance member and capable of disengaging drive transmission from the first driving source to the second conveyance member.

3. The image forming apparatus according to claim 2, wherein the first driving source is a motor rotatable either in a first direction or in a second direction opposite to the first direction, and wherein the clutch mechanism comprises a one-way clutch configured to transmit a rotation in the first direction of the motor to the second conveyance member so that the second conveyance member conveys a sheet and not to transmit a rotation in the second direction of the motor to the second conveyance member.

4. The image forming apparatus according to claim 1, wherein the restriction portion comprises a mechanism capable of switching the second conveyance member between a state of forming a nip for nipping a sheet and a state of not forming the nip.

5. The image forming apparatus according to claim 1, wherein the third conveyance member is a roller pair, and the controller is configured to execute the first operation such that the second sheet is conveyed to a position where a leading edge of the second sheet in the sheet conveyance direction abuts against a nip portion of the roller pair such that the second sheet is flexibly warped.

6. The image forming apparatus according to claim 1, wherein the third conveyance member is a roller pair, wherein the image forming apparatus further comprises a clutch mechanism disposed in a drive transmission train from the second driving source to the roller pair and permitting the roller pair to rotate in a state where the second driving source is stopped, and wherein the controller is configured to execute the first operation such that the second sheet is conveyed to a position where a leading edge of the second sheet in the sheet conveyance direction of the second sheet enters a nip portion of the roller pair.

7. The image forming apparatus according to claim 1, wherein the first conveyance member is capable of receiving and starting to convey a third sheet from the first conveyance path when the first conveyance member is driven by the first driving source during the second operation.

8. The image forming apparatus according to claim 1, wherein the controller is configured to execute, in a case of conveying the first and second sheets, either one of a first mode in which the first and second operations are executed and a second mode in which the second sheet is passed from the second conveyance member to the third conveyance member in a state where the second driving source is driving the third and fourth conveyance members and where the fourth conveyance member is conveying the first sheet.

9. The image forming apparatus according to claim 8, further comprising:

a registration member disposed on the first conveyance path and configured to convey a sheet to the image forming portion;

a third driving source configured to drive the registration member; and a detector configured to detect a sheet at a position between the second and third conveyance members, wherein the controller is configured to execute either the first mode or the second mode based on a detection result of the detector such that (a) the first mode is executed in a case where the second sheet arrives at the third conveyance member in a state where the first sheet is nipped by the fourth conveyance member and the third driving source has stopped driving the registration member, and (b) the second mode is executed in a case where the third driving source has started driving the registration member before the second sheet arrives at the third conveyance member.

10. The image forming apparatus according to claim 8, wherein the controller is configured to control the first and second driving sources such that a driving speed, when the second sheet is passed from the second conveyance member to the third conveyance member in the second mode, of the second conveyance member is smaller than that of the third conveyance member.

11. An image forming apparatus comprising:

a first conveyance path;

an image forming portion disposed along the first conveyance path and configured to form an image on a sheet;

a second conveyance path through which a sheet with an image formed by the image forming portion is guided to the first conveyance path;

a first conveyance member configured to convey a sheet through the second conveyance path in a sheet conveyance direction heading to the first conveyance path;

a second conveyance member disposed on the second conveyance path, located downstream of the first conveyance member in the sheet conveyance direction, and configured to convey a sheet in the sheet conveyance direction;

a third conveyance member disposed on the second conveyance path, located downstream of the second conveyance member in the sheet conveyance direction, and configured to convey a sheet in the sheet conveyance direction;

a fourth conveyance member disposed on the second conveyance path, located downstream of the third conveyance member in the sheet conveyance direction, and configured to convey a sheet to the first conveyance path;

a first driving source configured to drive the first and second conveyance members;

a second driving source configured to drive the third and fourth conveyance members;

a restriction portion capable of restricting driving force of the first driving source from acting on a sheet through the second conveyance member; and a controller configured to control the first and second driving sources so as to execute (i) a third operation in which the second driving source stops driving the third and fourth conveyance members while a first sheet being nipped at the fourth conveyance member and in which a second sheet is conveyed by the second conveyance member to a position where the second sheet abuts with the third conveyance member, and (ii) a fourth operation, to be executed after the third operation, in which the second driving source starts driving the third and fourth conveyance members in a state where driving force of the first driving source is restricted from acting on the second sheet by the restriction portion, wherein conveyance speeds of the third and fourth conveyance members in the fourth operation are set to be greater than that of the second conveyance member.

* * * * *